United States Patent [19]

Haje

[11] 4,098,199

[45] Jul. 4, 1978

[54] PORTABLE SAFE

[76] Inventor: Bassam N. Haje, 9034 Arlington Blvd., Fairfax, Va. 22030

[21] Appl. No.: 800,595

[22] Filed: May 25, 1977

[51] Int. Cl.[2] ..... E05G 1/024

[52] U.S. Cl. ..... 109/52; 109/79

[58] Field of Search ..... 109/50, 51, 52, 79; 312/258, 262

[56] References Cited

U.S. PATENT DOCUMENTS

| | | | |
|---|---|---|---|
| 1,184,094 | 5/1916 | Harrington | 109/79 |
| 1,822,448 | 9/1931 | Morin | 312/258 |
| 4,029,370 | 6/1977 | Ziegel et al. | 109/51 X |
| 4,030,426 | 6/1977 | Lyons | 109/51 |

*Primary Examiner*—Paul R. Gilliam

*Assistant Examiner*—David H. Corbin

*Attorney, Agent, or Firm*—Beveridge, DeGrandi, Kline & Lunsford

[57] ABSTRACT

A portable safe suitable for use by a traveler to secure valuables in a hotel or motel room. The safe includes top, bottom, side and end members hinged together to allow the safe to be opened to a substantially flat configuration for easy placement within luggage. When the traveler reaches his hotel or motel room, he raises the side and end members and fastens them in position with pins. The top member includes a lock for securing the top member in a closed position. Vacuum devices attached to the bottom member are actuable to secure the safe to any smooth flat surface such as a piece of furniture, a wall, a floor, a mirror, or a window.

9 Claims, 6 Drawing Figures

FIG. 1
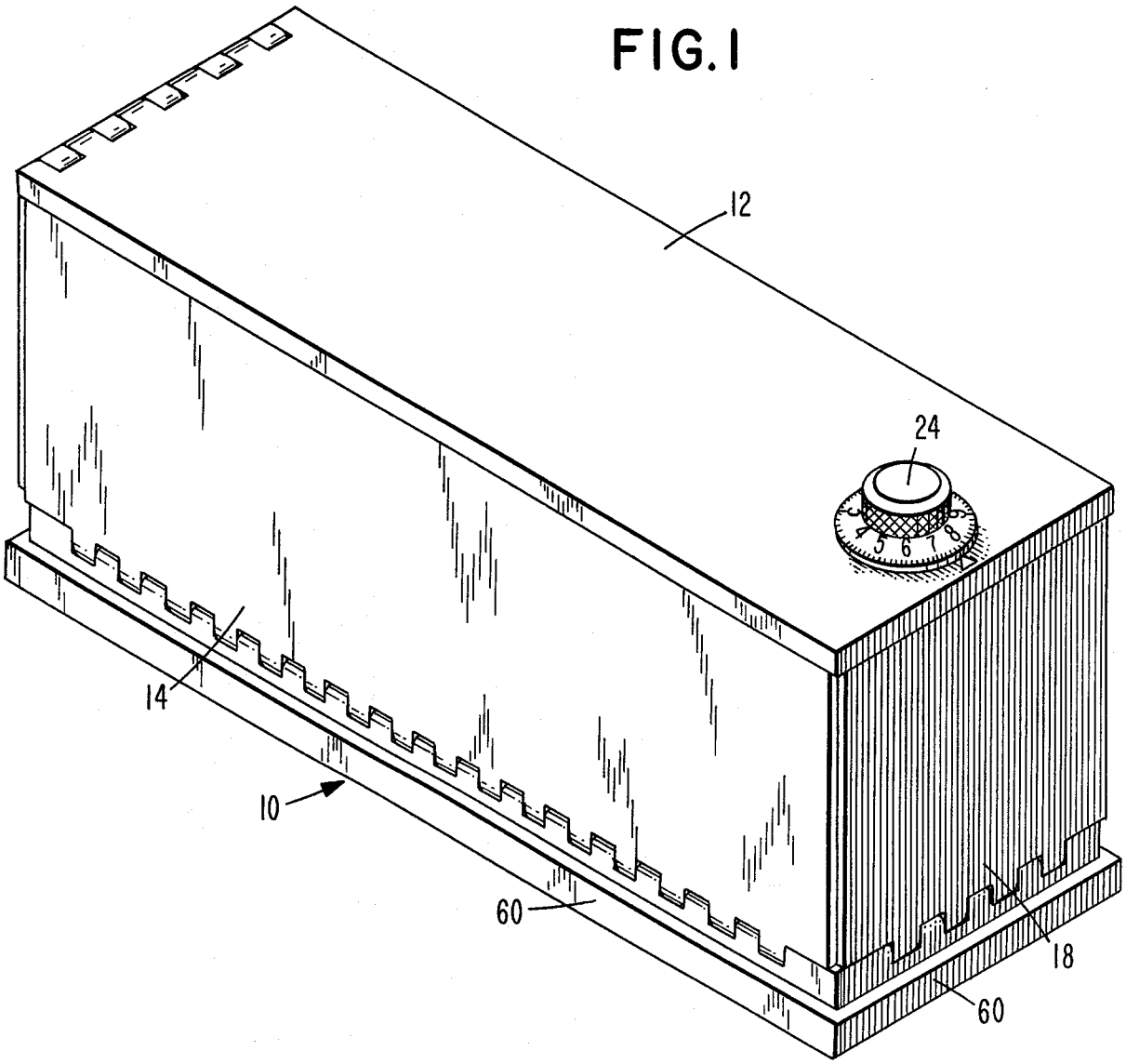
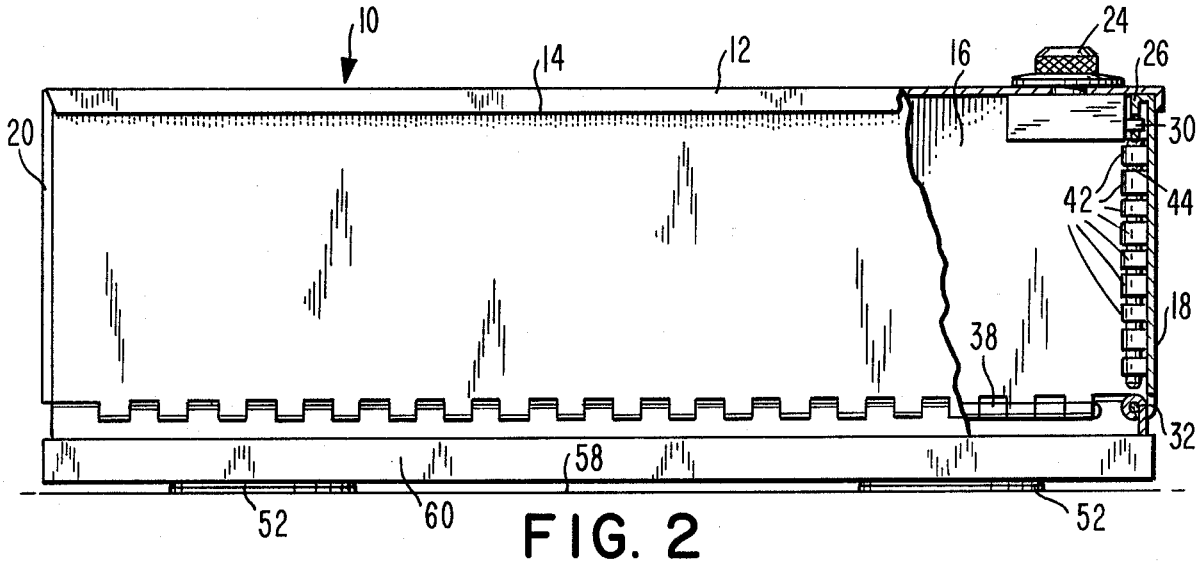
FIG. 2

PORTABLE SAFE

The present invention pertains to a portable safe. More particularly, the present invention pertains to a safe which can be unfolded to lie in a substantially flat configuration for ease of transporting, e.g., within luggage, and yet which can be assembled to provide a locked, immovable container for securing valuables.

Travelers frequently have valuable articles which they desire to keep secure and yet readily accessible. Many hotels and motels provide a safe adjacent the hotel or motel lobby in which travelers can secure valuables such as jewelry, money, and important papers. However, use of these facilities is inconvenient. In order to gain access, a hotel or motel employee must be contacted. Often, particularly in large hotels, the safe is a considerable distance from the traveler's room, adding to the inconvenience. If a traveler is out late at night, it may not be possible to gain access to the hotel or motel safe to secure jewelry or papers.

As a consequence of inconveniences such as these, many travelers simply lock their valuables inside their luggage. The lock on most luggage is not very strong or secure, and often numerous travelers with the same kind of luggage have matching keys. Luggage locks are, thus, easily opened by unauthorized persons, either with a matching key or forcefully, for example by prying,. Similarly, hiding valuables within drawers, closets or other furniture or fixtures of a hotel or motel room is generally unsatisfactory, as experienced thieves are familiar with the more common hiding places and so readily find valuables hidden in such places.

A professional thief, intent on finding a traveler's valuables, will ransack a hotel or motel room and force open locked luggage or other hiding places. While professional thieves account for a large dollar loss to travelers annually, still the number of instances of loss to professional thieves is relatively low in comparison to the number of instances of loss to amateur thieves. Amateur thieves, however, generally are interested in stealing items which can be rapidly picked up with little disturbance of other objects so as to increase the length of time before discovery of the loss. Therefore, to discourage an amateur thief, inconvenience is the principle thing required. If taking valuables presents sufficient inconvenience, most amateur thieves will not do so, instead preferring to look elsewhere for items to steal.

Portable safes intended for use by travelers have been developed. U.S. Pat. No. 3,858,531 shows a portable security container in the form of a clothes hanger. A vise-type locking mechanism is provided for securing the container to a closet rod. The body portion of the hanger provides an enclosed area for securing valuables. This portable security device, however, does not fit readily into luggage; instead, it is bulky and cumbersome. In addition, the entire security container, with the valuables inside, might be stolen by simply removing the closet rod, generally easily accomplished with a screwdriver, and sliding the security container off one end of the rod. U.S. Pat. No. 2,911,814 shows a portable safe which likewise can be locked over a closet rod. This portable safe, thus, also can be removed by first removing the closet rod. While this portable safe may be flat enough to fit within luggage without undue inconvenience, if so, it is so small that it cannot hold many items.

The present invention is a portable safe providing certain, secure protection for valuables and yet capable of being unfolded to lie substantially flat so as to fit readily within luggage, thereby overcoming these shortcomings with prior art safes. In accordance with the present invention, a number of panel members are provided, hinged together in a manner permitting them to be opened to a substantially flat configuration for ready placement within luggage, and also permitting them to be positioned to define an enclosure having a lock to retain it securely closed. One surface of the enclosure is provided with means such as a vacuum base or valved suction cup permitting the enclosure to be securely fastened to any available substantially smooth surface, for example on a piece of furniture, a wall, a mirror, or a window. A traveler using the portable safe of the present invention transports it opened flat within his luggage. Upon reaching a hotel or motel, the traveler positions the panel members to define the enclosure and inserts a pin member at the newly formed corners, retaining the enclosure in its assembled configuration. The enclosure is then positioned on a suitable surface, and the vacuum base actuated to secure the enclosure to the surface. Valuables are then placed within the enclosure, and the enclosure top is then closed and locked, securing the valuables therein. When access to the interior of the safe is desired, to insert or remove valuables, the lock is operated to permit opening of the top. When the traveler is to permanently leave, he opens the safe top, removes all the valuables, actuates the vacuum base to permit removal of the safe, and removes the corner pins, permitting the safe to be unfolded to its substantially flat configuration. Alternatively, the traveler can actuate the valves to remove the safe while retaining the safe in its assembled condition. The safe can then readily be transported within the traveler's luggage until use is again desired. Although the portable safe is described in conjunction with use by a traveler in a hotel or motel room and transporting within luggage, numerous other uses can, of course, be found.

These and other aspects and advantages of the present invention are more apparent in the following detailed description and claims, particularly when considered in conjunction with the accompanying drawings in which like parts bear like reference numerals. In the drawings:

FIG. 1 is a perspective view of a portable safe in accordance with the present invention depicted in its assembled configuration;

FIG. 2 is a side elevational view, partially broken, of the safe of FIG. 1, again fully assembled;

Figure 3:
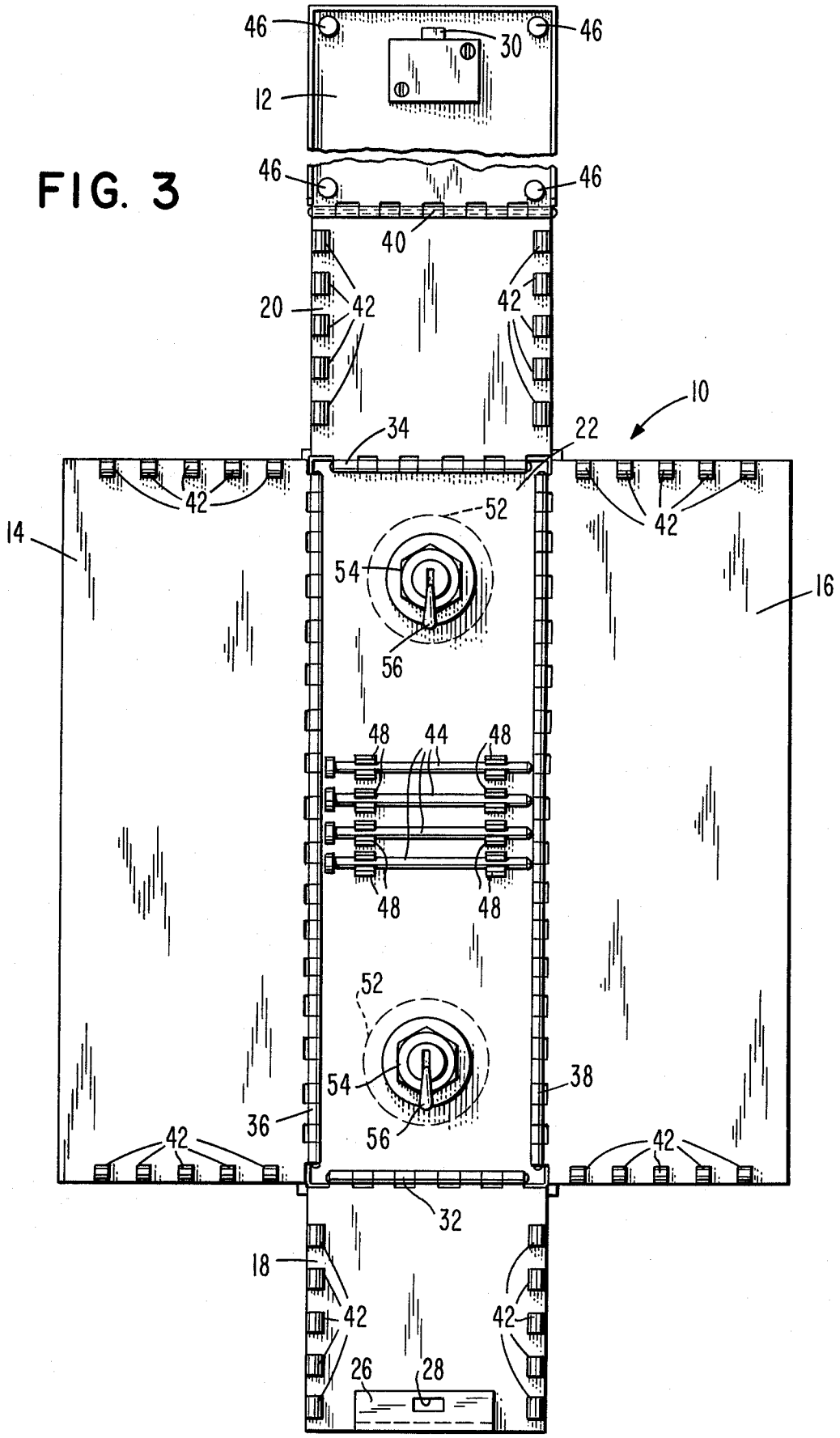
FIG. 3 is a top plan view of the safe of FIG. 1 opened to its substantially flat configuration.
Figure 4:
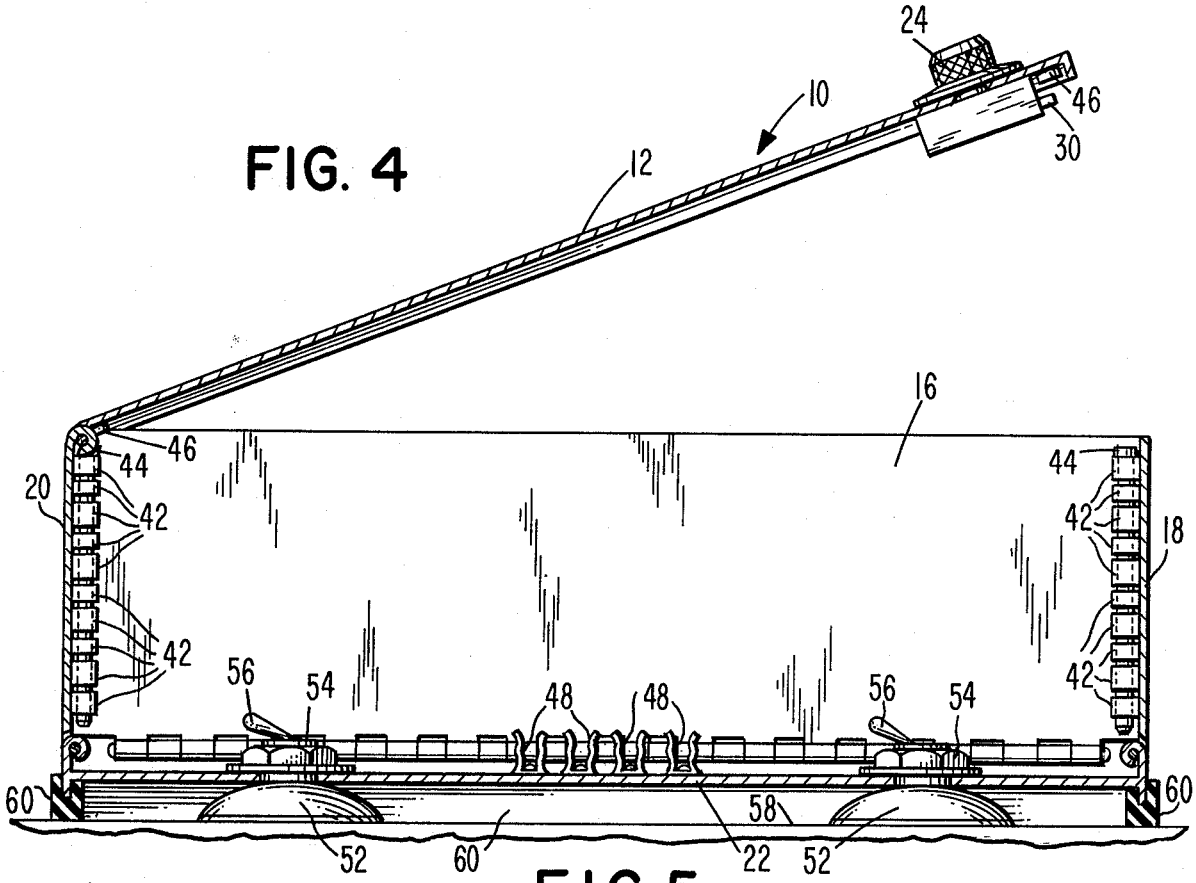
FIG. 4 is a side sectional view taken along line 4-4 of FIG. 5.
Figure 5:
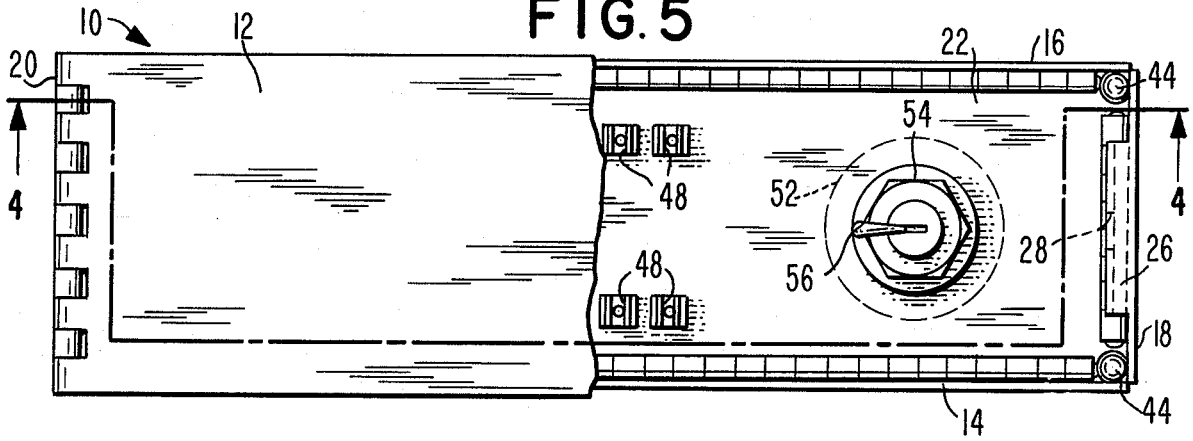
FIG. 5 is a top plan view, partially broken of a portable safe in accordance with the present invention in its assembled configuration.
Figure 6:
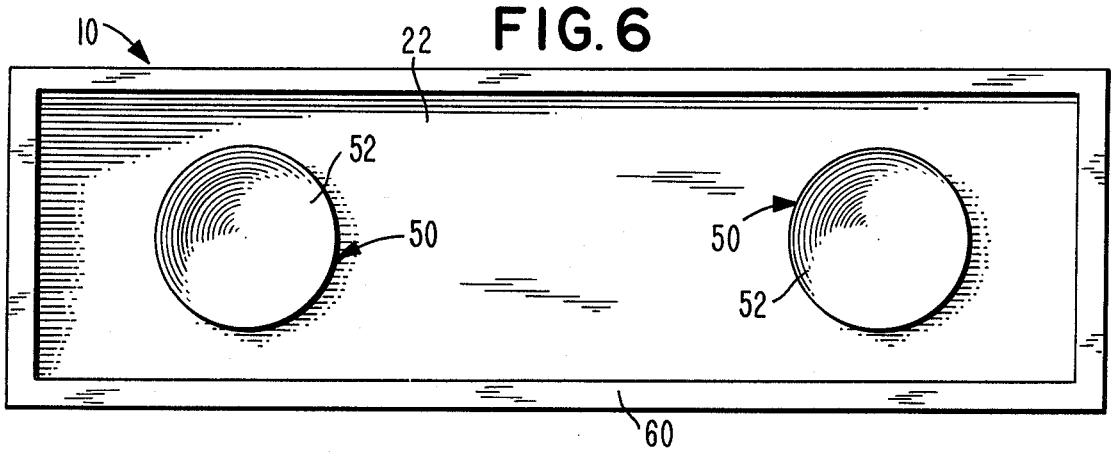
FIG. 6 is a bottom plan view of the safe of FIG. 1.

Portable safe 10, depicted in the drawings, includes top member 12, first and second side members 14 and 16, first and second end members 18 and 20 and bottom member 22. A lock 24 is provided in top member 12 adjacent the end of top member 12 that contacts end member 18 when top member 12 is closed. As seen in FIG. 2, end member 18 is provided with a lip 26 having an opening 28 (FIG. 3) therein for receipt of tongue 30 of lock 24. Although lock 24 is preferably a combination lock as depicted in the drawings, a key-operated lock could be utilized in accordance with the present invention. End member 18 is hingedly connected to bottom member 22 by means of hinge 32. Likewise, end member 20 is hingedly connected to bottom member 22 by means of hinge 34, side members 14 and 16 are hingedly connected to bottom member 22 by hinges 36 and 38, and top member 12 is hingedly connected by hinge 40 to the edge of end member 20 opposite the hinged joint of end member 20 and bottom member 22. Each hinge 32, 34, 36, 38, and 40 preferably is configured like a piano hinge to extend substantially the full length of the two surface members which it joins and rotates sufficiently to permit portable safe 10 to be positioned substantially flat, as depicted in FIG. 3, or assembled to provide an enclosure, as depicted in FIGS. 1, 2, 4 and 6. Preferably, the hinges are located so as to be on the interior of the enclosure, as seen in FIGS. 2, 4 and 5, although if desired the hinges could be on the outside of the assembled portable safe.

The two edges of each side member 14 and 16 and of each end member 18 and 20 which extend substantially vertically in the assembled configuration of FIGS. 1, 2, 4 and 5 are provided with interleaving loop members 42, similar to a door hinge. In the assembled position of the portable safe, the loops of contiguous end and side members interleave, and a pin 44 is inserted through the several loop openings to retain the interleaved loops in their assembled positions. Preferably, a resilient pad 46 is provided at each corner on the interior surface of top member 12, as depicted in FIG. 3, to resiliently retain each pin 44 fully inserted when top 12 is closed. Likewise, preferably, a number of pairs of retaining clips 48, equal to the number of pins 44, is provided on the interior surface of bottom member 22 to retain the pins 44 securely when portable safe 10 is opened and lying substantially flat.

One or more actuable vacuum bases or valved suction cups 50 are provided on bottom member 22 to retain portable safe 10 immovable on a suitable surface. The drawings show two vacuum bases 50 on bottom member 22, but any suitable number could be utilized. Each vacuum base 50 includes a vacuum portion 52, extending exteriorly of bottom member 22, and a valve portion 54, extending interiorly of base member 22 and operatively associated with the vacuum portion. The drawings illustrate the valve portions 54 as including an actuating device 56 movable from a first position in which, with the associated vacuum portion 52 firmly abutting a smooth surface 58, sufficient vacuum is created to retain portable safe 10 firmly affixed to surface 58, and movable to a second position in which the vacuum is released, permitting ready removal of safe 10 from surface 58. Numerous types of vacuum bases or valved suction cups could be utilized for vacuum bases 50. By way of example, vacuum devices of the type utilized to permit carrying of large plate glass sheets might be utilized. U.S. Pat. No. 3,159,370 shows a vacuum base which might be adapted for use as vacuum bases 50.

Preferably, a resilient but tough skirt member 60 is provided along the length of each edge of bottom member 22. As depicted in FIG. 2, with vacuum bases not actuated, the vacuum portions 54 extend to maintain the lower edge of each skirt 60 slightly above surface 58. When vacuum devices 50 are actuated, the vacuum pulls portable safe 10 toward surface 58 until the bottom edge of each skirt member 60 contacts surface 58, as depicted in FIG. 3. Because the skirt members 60 are resilient, surface 58 is not harmed, but because skirt members 60 are tough, they cannot be readily flexed, and so they cover vacuum bases 50, and a stick, knife, or other such object cannot be inserted beneath skirt 60 to probe the vacuum bases 50 in an attempt to break the vacuum and free portable safe 10 from surface 58. Skirt members 60, by way of example, might be formed of a tough rubber, similar to that from which automobile tires are made.

When it is desired to travel, portable safe 10 is opened out to its substantially flat position, as depicted in FIG. 3, and placed within the traveler's luggage. When he reaches his destination, the traveler raises the side members 14 and 16 and the end members 18 and 20 to the positions of FIG. 2 and inserts the pins 44 through the interleaved loops 42. The portable safe is then positioned on a substantially smooth, flat surface, such as the top of a piece of furniture, the wall, the floor, a mirror or window, and the actuating device 56 of each vacuum base 50 is operated to secure safe 10 to the surface. Valuables are then placed within safe 10, cover 12 is closed, and lock 24 operated to secure the valuables within the safe. When it is desired to have access to the valuables, lock 24 is actuated to permit opening of cover 12. When the traveler is ready to depart, the safe is opened, pins 44 removed from loops 42, and actuating devices 56 operated to permit ready removal of safe 10 from the surface. Pins 44 can then be retained in clip 48, and safe 10 moved to its substantially flat configuration and packed within luggage. Alternatively, actuating devices 56 can be operated with pins 44 still within loops 42, and safe 10 can then be moved in its assembled condition, either within luggage or otherwise.

While FIG. 3 shows safe 10 opened fully to a substantially flat position, a safe in accordance with the present invention could be provided with a hinge 34 or 40 allowing end member 20 or top member 12 to move to a position overlying bottom member 22, thereby reducing the area required for placement of the safe within luggage. Other such modifications could likewise be made. Thus, although the present invention has been described with reference to a preferred embodiment, numerous rearrangements and modifications could be made, and still the result would be within the scope of the invention.

What is claimed is:

1. A portable safe comprising a bottom panel member;

a top panel member;

a plurality of further panel members;

a plurality of hinges connected to said panel members to hingedly connect said bottom panel member, said top panel member, and said further panel members for hinged movement between a first position, in which said bottom panel member, said top panel member, and said further panel members lie substantially flat, and a second position, in which said bottom panel member, said top panel member, and said further panel members cooperate to define an enclosure with said hinges on the interior thereof;

a plurality of pin members;

each of said further panel members having on two edges thereof a plurality of loop members positioned so that, when said panel members are in said second position, the loop members of adjacent ones of said further panel members interleave to receive said pin members, whereby said panel members are retained in said second position;

lock means for locking said top panel member to one of said further panel members in said second position to provide a locked enclosed space within said members while permitting unlocking thereof; and actuable securing means connected to one of said panel members and including a securing position positioned to be outside the enclosure when said panel members are in said second position; an actuating portion positioned to be within the enclosure when said panel members are in said second position for actuating said securing portion to secure said one of said panel members, and thus said portable safe, to a surface; and cover means for covering said securing portion and cooperating with the surface to prevent access to said securing means when said portable safe is secured to the surface.

2. A portable safe as claimed in claim 1 in which said plurality of further panel members comprises first and second side panels, hingedly connected to first and second sides of said bottom panel member, and first and second end panels, hingedly connected to first and second ends of said bottom panel member.

3. A portable safe as claimed in claim 2 in which said bottom panel member is rectangular.

4. A portable safe as claimed in claim 1 in which each of said hinges is a piano hinge.

5. A portable safe as claimed in claim 1 further comprising a plurality of clip members attached to one of said panel members to retain said pin members when said panel members are in said first position.

6. A portable safe as claimed in claim 1 in which said cover member comprises a skirt member extending from said one of said panel members.

7. A portable safe as claimed in claim 1 in which said securing portion comprises vacuum means.

8. A portable safe as claimed in claim 7 in which said vacuum means comprises a vacuum member for contacting a surface to which said safe is to be fastened, and in which said actuating portion comprises a valve member actuable between a first valve position, in which with said vacuum member contacting a surface a vacuum is created between said vacuum member and the surface to retain said safe fastened to the surface, and a second valve position, in which any vacuum is released.

9. A portable safe as claimed in claim 8 in which said securing means comprises two of said vacuum means.

* * * * *